US007626560B2

(12) United States Patent
Conrad

(10) Patent No.: US 7,626,560 B2
(45) Date of Patent: Dec. 1, 2009

(54) FOLDING FEED MECHANISM AND METHOD FOR A MOBILE SATELLITE SYSTEM

(75) Inventor: Timothy John Conrad, Mt. Pleasant, IA (US)

(73) Assignee: Winegard Company, Burlington, IA (US)

( * ) Notice: Subject to any disclaimer, the term of this patent is extended or adjusted under 35 U.S.C. 154(b) by 227 days.

(21) Appl. No.: 11/863,812

(22) Filed: Sep. 28, 2007

(65) Prior Publication Data

US 2009/0085825 A1 Apr. 2, 2009

(51) Int. Cl.
*H01Q 1/08* (2006.01)
*H01Q 3/02* (2006.01)
*H01Q 1/32* (2006.01)

(52) U.S. Cl. ..... 343/881; 343/882; 343/711

(58) Field of Classification Search ..... 343/711, 343/713, 761, 765, 840, 878, 880, 881, 882
See application file for complete search history.

(56) References Cited

U.S. PATENT DOCUMENTS 4,663,633 A * 5/1987 Wilson ..... 343/714
5,337,062 A 8/1994 Sherwood et al.
5,418,542 A 5/1995 Sherwood et al.
5,515,065 A 5/1996 Sherwood et al.
5,528,250 A 6/1996 Sherwood et al.
5,554,998 A 9/1996 Sherwood et al.
5,646,638 A 7/1997 Winegard et al.
6,023,247 A 2/2000 Rodeffer
6,188,300 B1 2/2001 Rodeffer
7,230,581 B2 6/2007 McEwan
2006/0038728 A1 2/2006 McEwan
2007/0013604 A1 1/2007 McEwan
2008/0055170 A1 * 3/2008 Madden et al. ..... 343/713

* cited by examiner

*Primary Examiner*—Hoang V Nguyen
(74) *Attorney, Agent, or Firm*—Dorr, Carson & Birney, P.C.

(57) ABSTRACT

A folding feed for a mobile satellite system having a reflector antenna, a feed, and a feed arm. The feed arm carries the feed at its distal end. A pivot is provided between the distal end and the feed. A feed stop block, connected at the distal end, has first and second surfaces. When the mobile satellite system stows the antenna, the feed pivots to abut the first surface against the feed to hold the feed at a first set angle. When said mobile satellite system deploys the antenna, the feed pivots to abut the second surface against the feed to hold the feed at the second set angle. A spring connected between the feed arm and feed holds the second surface against the feed. The first angle is greater than the second angle to provide a low profile to the stowed antenna.

20 Claims, 8 Drawing Sheets

Fig 3
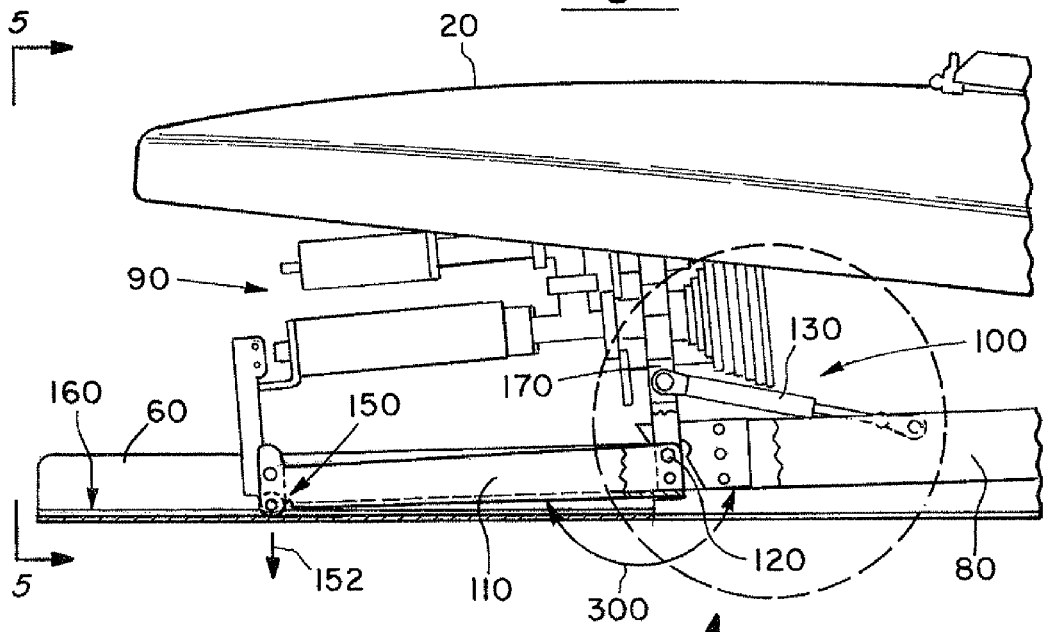
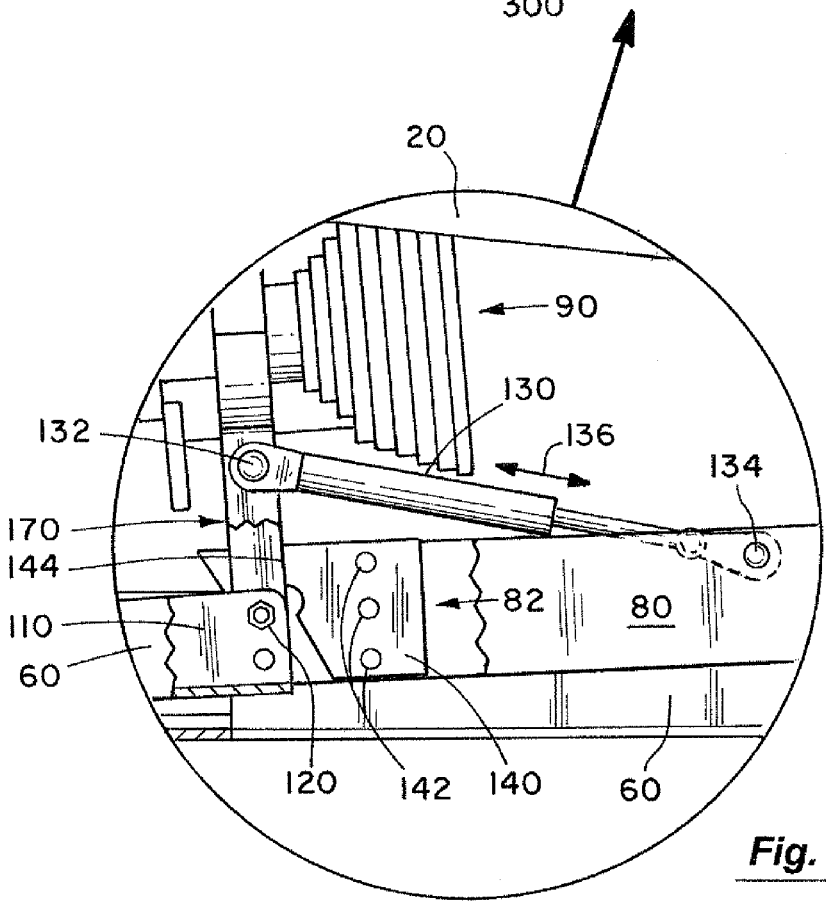
Fig. 4

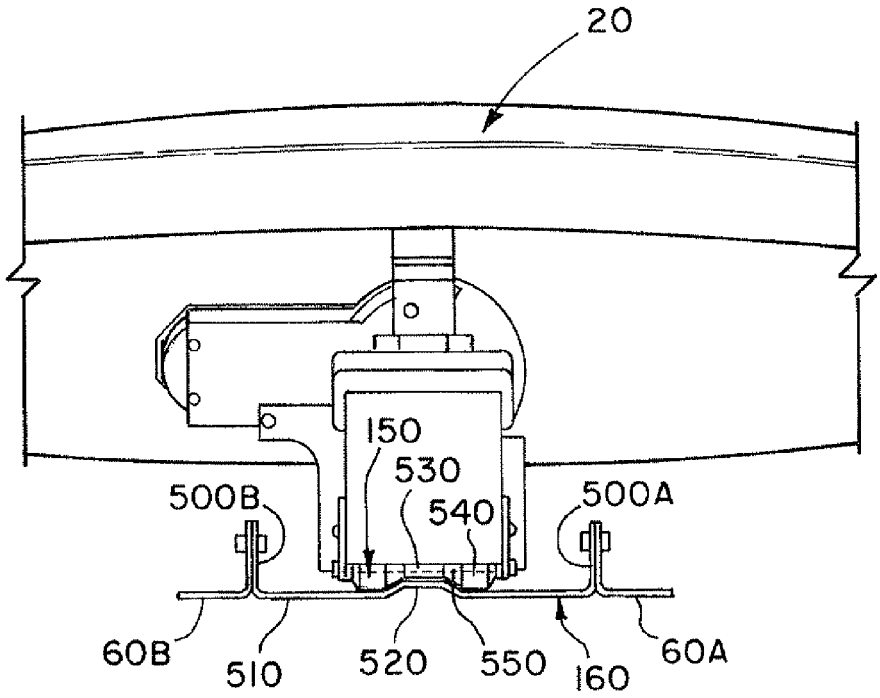
Fig. 5
Fig. 6
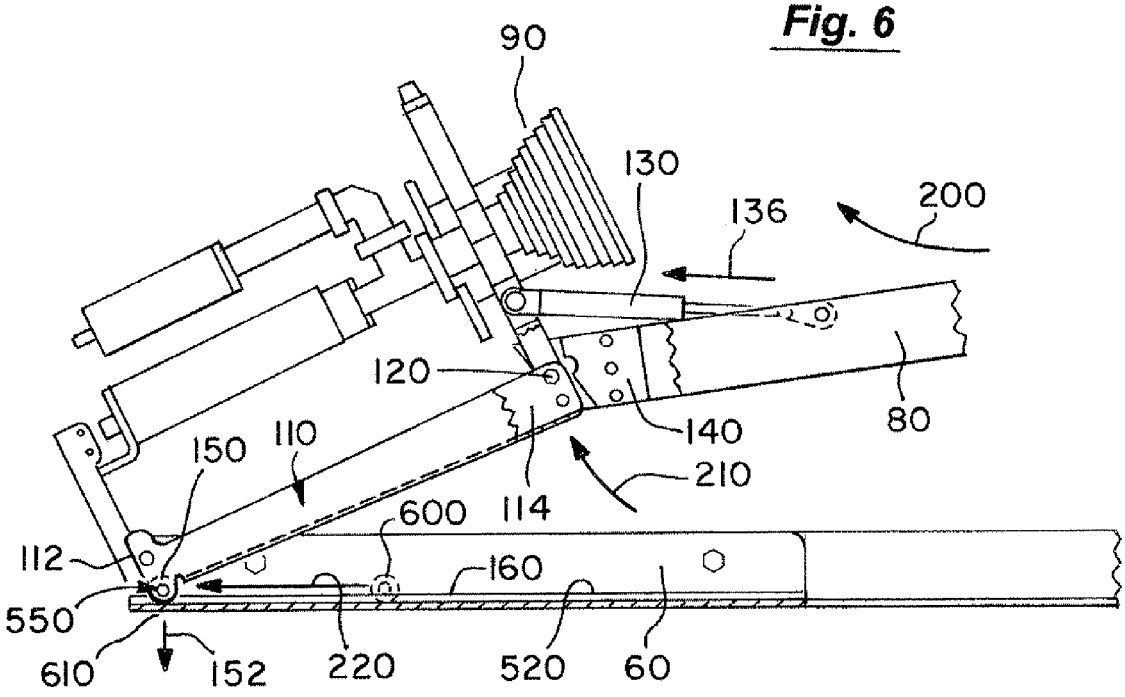

FOLDING FEED MECHANISM AND METHOD FOR A MOBILE SATELLITE SYSTEM

BACKGROUND OF THE INVENTION

1. Field of the Invention

The field of invention relates to mobile satellite systems and, in particular, to stowing mobile satellite systems with a folding feed.

2. Discussion of the Background

Mobile satellite systems are being increasingly used throughout the world especially in diverse geographic locations to target and to have two-way communication with a desired satellite. Such systems are mounted on a variety of vehicles such as trucks, trailers, RVs, SUVs, marine vessels, and may be contained in boxes that can be packed and shipped. A need exists to provide a low profile to the mobile satellite systems when the reflector antenna is stowed for non-use, storage, shipping or transport.

Mobile satellite systems require higher wattage transmitters, such as three or four watts, when used in geographic areas of weak signals or in weather conditions of heavy rain, snow, etc. Higher wattage transmitters occupy more room on the feed and a need exists to maintain the low profile of the stowed mobile satellite system while providing the higher wattage transmitter.

SUMMARY OF THE INVENTION

A folding feed mechanism and method for a mobile satellite system having a reflector antenna, a feed, and a feed arm. The feed arm has a distal end carrying the feed when said reflector antenna is deployed. A pivot is provided between the distal end of the feed arm and the feed. A feed stop block is connected at the distal end of the feed arm having first and second surfaces. A gas spring has a first end connected to the feed arm and a second end connected to the feed. When the mobile satellite system stows the reflector antenna, the feed pivots to abut the first surface of the feed stop block against the feed thereby holding the feed at a first set angle (less than 180 degrees) with the feed arm. When the mobile satellite system deploys the reflector antenna, the feed pivots to abut the second surface of the feed stop block against the feed to hold the feed at a second set angle (less than 180 degrees) with the feed arm. The gas spring applies a force to hold the second surface against the feed. The first angle being greater than the second angle to provide a low profile to the stowed reflector antenna in the mobile satellite system and to accommodate larger feeds.

A method for folding a feed of a mobile satellite system by moving the feed about a pivot on a distal end of a feed arm as the mobile satellite system stows; by stopping the movement of the feed about the pivot during stow when a first surface of a feed stop block on the distal end abuts the feed; by moving the feed about the pivot when the mobile satellite system deploys; by stopping the movement of the feed about the pivot during deploy when a second surface of a feed stop block on the distal end abuts the feed; and by holding the feed against the second surface with a spring connected between the feed and the feed arm.

BRIEF DESCRIPTION OF THE DRAWINGS

FIG. 3 is a partial side view showing the folding feed mechanism of the present invention folded.

FIG. 4 is a side view close up of the folding feed mechanism of FIG. 3.

FIG. 5 is an end view of the feed.

FIG. 6 is a side view of the folding feed as it lifts off during deployment.

DETAILED DESCRIPTION OF THE INVENTION

Figure 1:
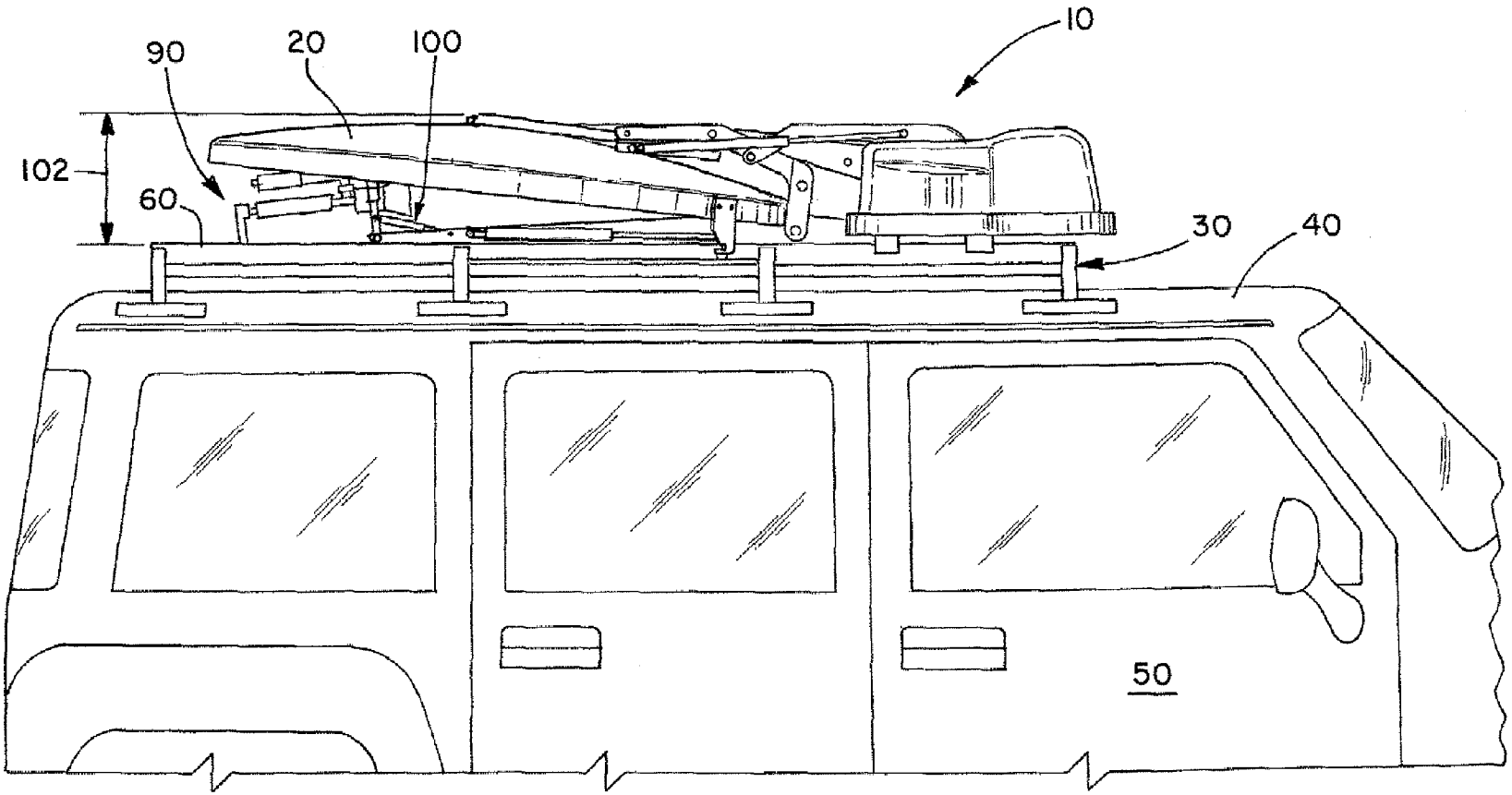
FIG. 1 is a side view of a stowed mobile satellite system having the folding feed of the present invention.
Figure 2:
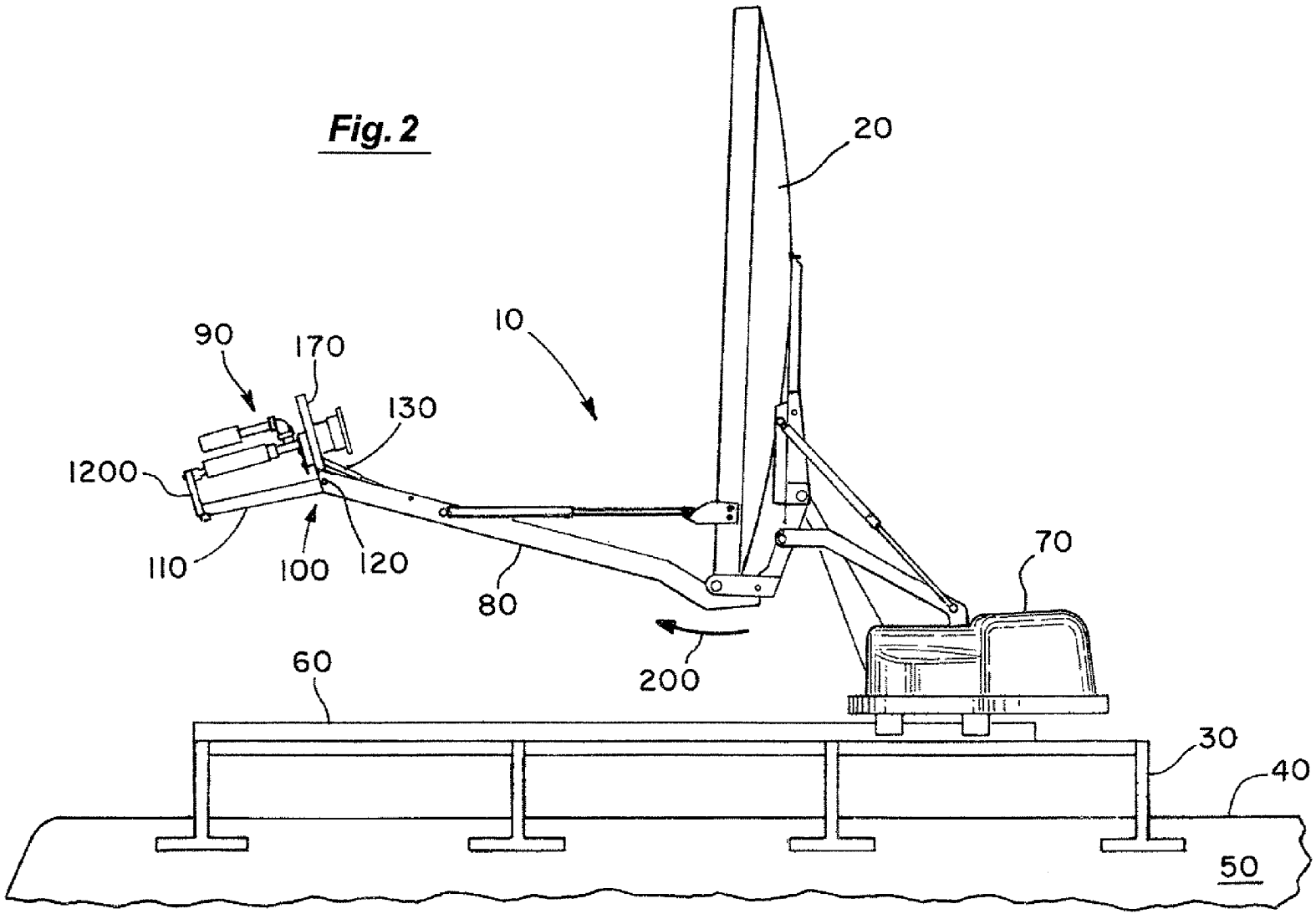
FIG. 2 is a side view of the mobile satellite system of FIG. 1 deploying with the feed unfolded.

In FIG. 1, the mobile satellite system 10 of the present invention is shown, with the reflector antenna 20 in a stowed position, on a mount 30 on an upper surface 40 of a vehicle 50. The vehicle 50 can be any suitable vehicle such as a truck, van, SUV, trailer, RV, marine vessel, transport, container, etc. FIG. 2 shows the reflector antenna 20 deploying as shown by arrow 200.

The mobile satellite system 10 of FIGS. 1 and 2 conventionally has rail(s) 60 on a mount 30 on a mounting surface 40; a housing 70 containing motors, gears, controls (all not shown); and a feed support arm(s) 80 carrying a feed 90. An example of a mobile satellite system 10 is set forth in U.S. Pat. No. 7,230,581 which is incorporated herein by reference.

The folding mechanism 100 is shown in FIGS. 1 and 2 to accommodate large feeds 90 such as those using three and four watt transmitters, yet retain a low profile. For example, assume a 1.2 meter reflector antenna 20 is shown in FIG. 1. A three watt transmitter, for example, may be 6.5 inches long, 4.5 inches wide, and 1.7 inches high. A four watt transmitter, for example, may be 7 inches long, 6.5 inches wide, and 2.9 inches high. In FIGS. 1 and 2, the folding mechanism 100 of the present invention can accommodate either size of transmitter. In FIG. 1, a stow height 102 above the rail 60 for either a three or four watt transmitter, of the example, is 12.5 inches. The feed 90 is mounted to a tray 110 which pivots at point 120, under the teachings of the present invention, at the distal end of the feed arm(s) 80 away from the deployed reflector antenna 20.

The folding mechanism 100 of the present invention is shown in FIGS. 3 and 4 stowing the feed 90 under the reflector antenna 20 and on the rails 60 (the mount 30 is not shown). The folding mechanism 100 includes tray 110, the pivot point 120 (one on either side of tray 110), the gas spring 130, the feed stop blocks 140 (one on each arms 80A and 80B of feed arm 80). A roller 150 connected to the tray 110 and a ramp 160 connected between the rails 60 are also used. The tray 110 is connected with a pivot 120 to the feed block 170 and distal end 82 of the feed arm(s) 80. The gas spring 130 is connected with pivot head joints 132, 134 between a feed block 170 of feed 90 and the feed arm(s) 80. The gas spring 130 provides a constant force as shown by arrow 136 in FIG. 4. Each feed stop block 140 is connected by means of three bolts to the inside end 82 of the feed arms 80A, 80B when there are two arms in the feed arm 80.

In operation and best shown in FIG. 4, the feed stop block 140 has a surface 144 that abuts against the feed block 170 to stop further pivoting of the tray 110 and the feed block 170 in the ramp 160. The gas spring 130 provides a constant force of, for example 15 pounds, throughout its range as shown by arrow 136 about pivot 120. The gas spring 130 is required, as explained later, to pivot the feed 90 into an operational deployed position and to hold it there. When stowed, as shown in FIGS. 3 and 4, the force 136 from the gas spring is not required. As shown in FIG. 3, an angle 300 less than 180 degrees is formed between the feed arm 80 and the tray 110 of the feed 90. For example, angle 300 may be 177 degrees which contributes to the low profile 102.

In FIG. 5, the details of the roller 150 and the ramp 160 are shown. The ramp 160 has sides 500A, 500B which are connected, such as with bolts, to the rails 60A, 60B. The ramp 160 has a flat bottom 510 that parallels the rails 60A, 60B with an upwardly extending guide 520. The guide 520 is located on a centerline between the sides 500A, 500B. As will described later, the roller 150 has a recessed region 530 that substantially mates with the guide 520 and opposing roller regions 540 that engage the flat bottom 510. The roller 150 is connected with an axle 550 to the tray 110. The guide 520 centers the roller 150 (and thus, the feed 90 in the tray 110) during the start of deployment and at the end of stowing.

In FIG. 6, the feed 90 is starting to be deployed by the feed arm(s) 80 moving as shown by arrow 200 (see FIG. 1) so that the front of the feed 90 moves upwardly as shown by arrow 210. During the initial deploy of the mobile satellite system 10, the roller at the end 112 of the tray 110 moves along the ramp 160 from a stowed position 600 in the direction of arrow 220 to a lift off position 610 as the other end 114 of the tray 110 moves up in the direction of arrow 210. During this time the gas spring 130 provides constant force as shown by arrow 136. A force 152 results from this constant force 136 at the roller 610 against the ramp 160 just prior to lift off at point 610. The guide 520 is a given length long, at least the distance from point 600 to point 610. Stowing of the mobile satellite system 10 is the reverse process from that just described. As the feed 90 is lowered towards the rails 60, the roller 150 first abuts at about point 610 and the mating of the roller 150 with the guide 520 in the ramp 160 aligns the feed 90 with the center of the rails 60A, 60B. When fully stowed, the roller 150 is stationary in the ramp 160 at about position 600.

Figure 7:
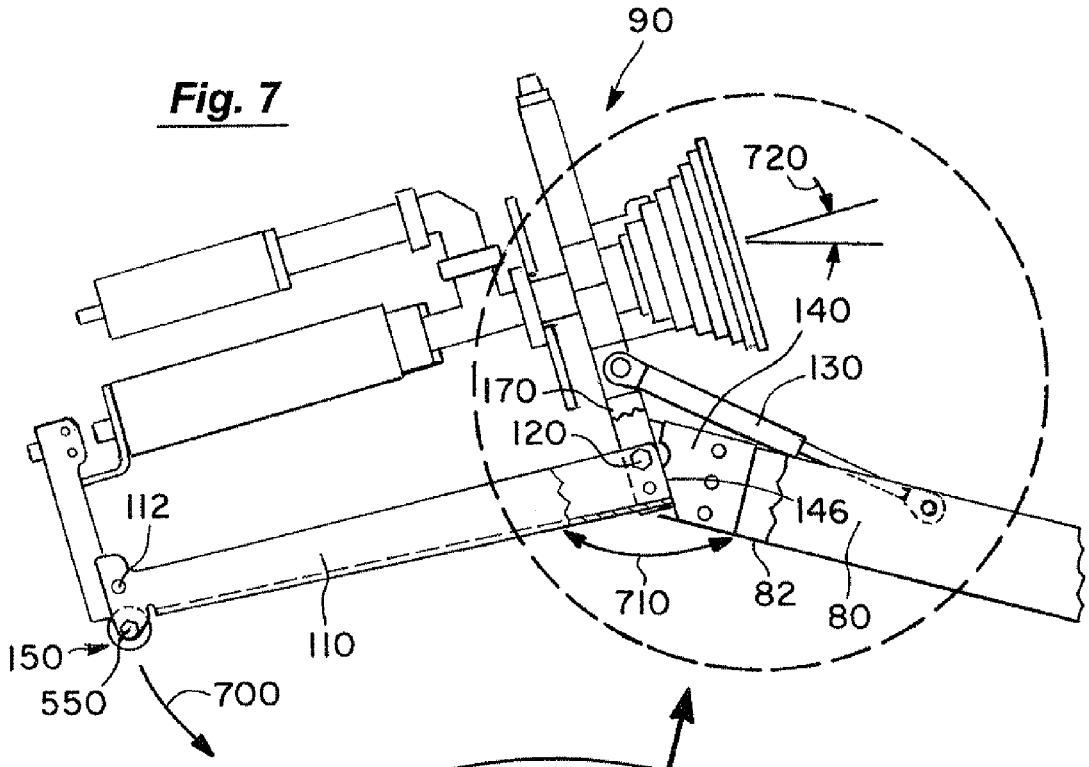
FIG. 7 is a side view of the folding feed of the present invention unfolded to hold the feed at a fixed angle with respect to the feed arm.
Figure 8:
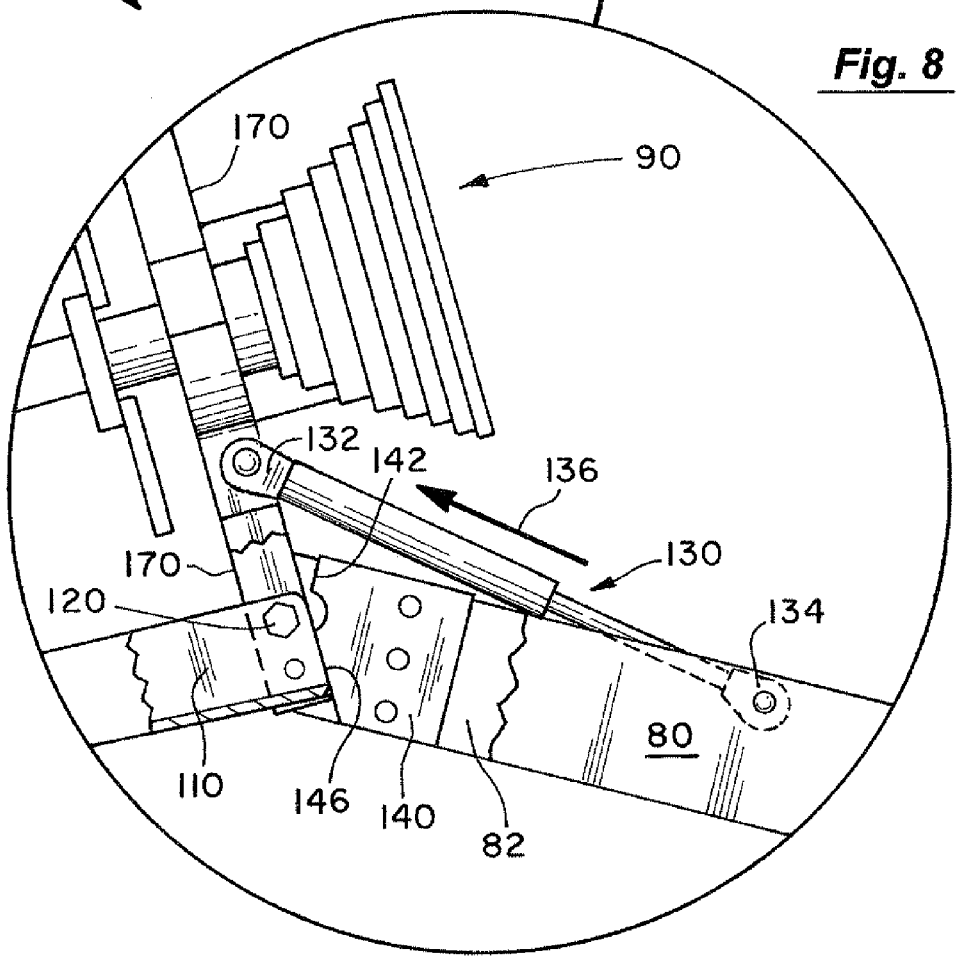
FIG. 8 is a side view close up of the folding feed mechanism of FIG. 7.

In FIGS. 7 and 8, the feed 90 is deployed and targeted on a satellite (not shown). When the deployment continues 200 in FIG. 6 and the roller 150 lifts off from the ramp 160, the gas spring 130 moves the end 112 of the tray down in the direction of arrow 700 about pivot 120 until the surface 146 of the feed stop block 140 firmly abuts the feed block 170 as best shown in FIG. 8. The gas spring 130, as extended, provides the constant force 136 of 15 pounds to hold the feed 90 firmly against the feed arms 80A, 80B of feed 80 even in adverse weather conditions such as wind speeds of about 35 mph.

More generally stated, the feed stop block 170 on each arm 80A, 80B of feed arms 80 abuts against the feed 90, as the feed block 170, is a part of the feed 90. Based on design consideration(s), any suitable part or component of the feed 90 can be used to abut against the surfaces 144 and 146.

As shown in FIG. 7, an angle 710, less than 180 degrees is formed between the feed arm 80 and the tray 110 of the feed 90. For example, angle 710 may be 150 degrees which provides about a 30 degree focus angle 720 for the feed 90. This angle 710 is achieved soon after lift off of the roller 150 from the ramp 160 and is maintained by the gas spring 130 as the mobile satellite system 10 is deployed and targeted on a satellite. The action of the gas spring 130 to firmly abut surface 144 of the feed stop block 140 against the feed block 170 provides a substantially rigid connection between the feed arms 80 and the feed 90 to maintain satellite communication is adverse weather conditions. It is to be understood that the design of the feed 90 and the feed arm(s) 80 can be any suitable design and is not limited to that shown.

Figure 9:
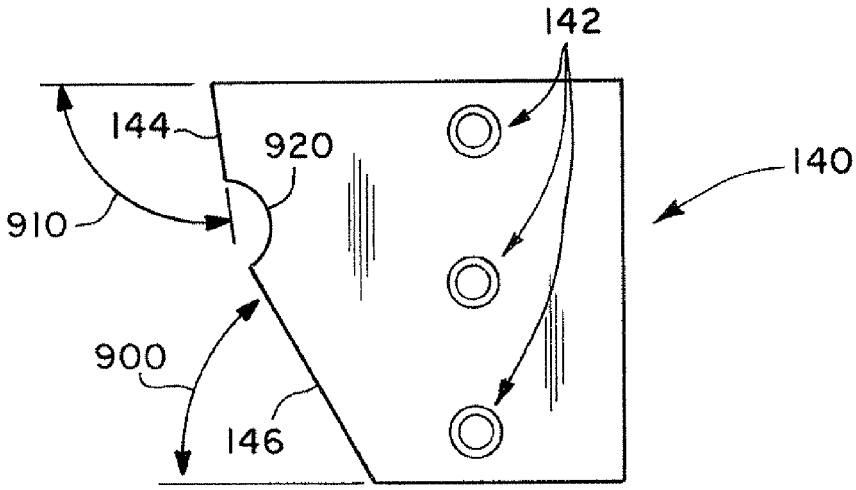
FIG. 9 is an orthogonal side view of the feed stop block of the present invention.
Figure 10:
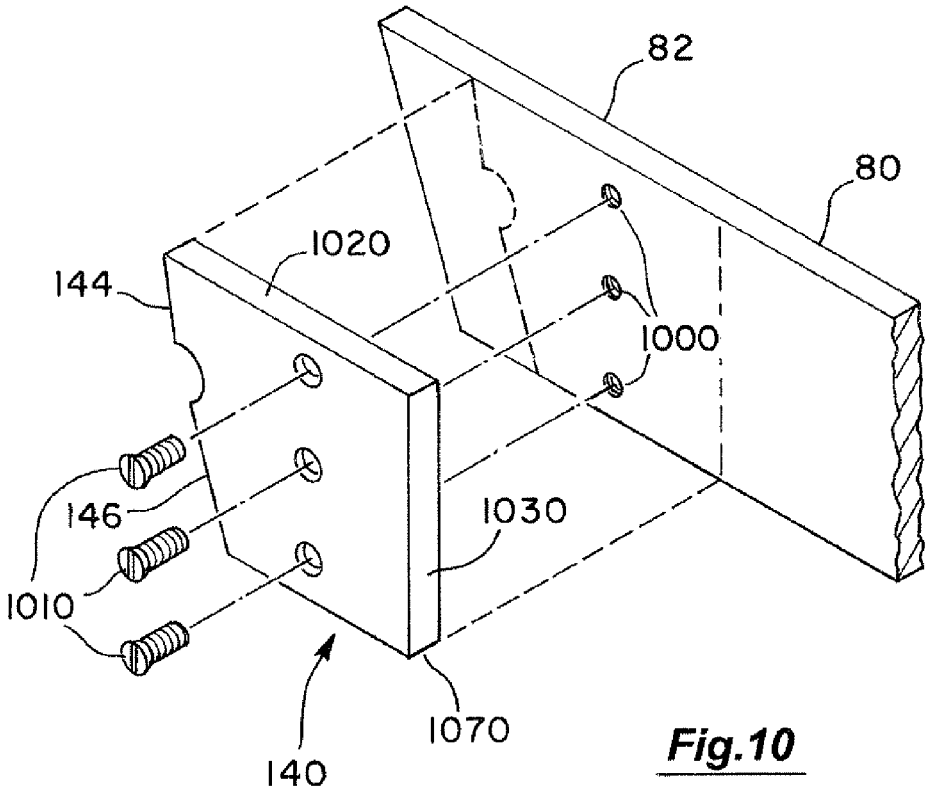
FIG. 10 is an exploded view showing connection of the feed stop block to the support arm.

In FIGS. 9 and 10, details of the feed stop block 140 are shown. The feed stop block 140 is machined of metal to have holes 142 and surfaces 144 and 146. A deploy surface 146 has an angle 900 of about 60° and a stow surface 144 has an angle 910 of about 98°. The angles 900 and 910 vary dependent on the specific design of a mobile satellite antenna system 10. The curved region 920 provides a transition region between the two angle surfaces 900 and 910 and can be any suitable shape.

In FIG. 10, the feed stop block 140 is shown attached to a feed arm 80 at the distal end 82. Formed holes 1000 are threaded to receive bolts 1010 which firmly hold the feed stop block 140 to the feed arm 80. Any suitable connection other than that shown could be used to affix the feed stop block 140 to the feed arm 80. For example, the block 140 could be welded on or it could be integral with the arm 80. By way of example, the feed stop block is two inches on sides 1020, 1030 and one-half inch wide 1040. As the feed arm 80 has two parallel arms 80A, 80B, a feed stock block 140 is used on each arm.

Figure 11:
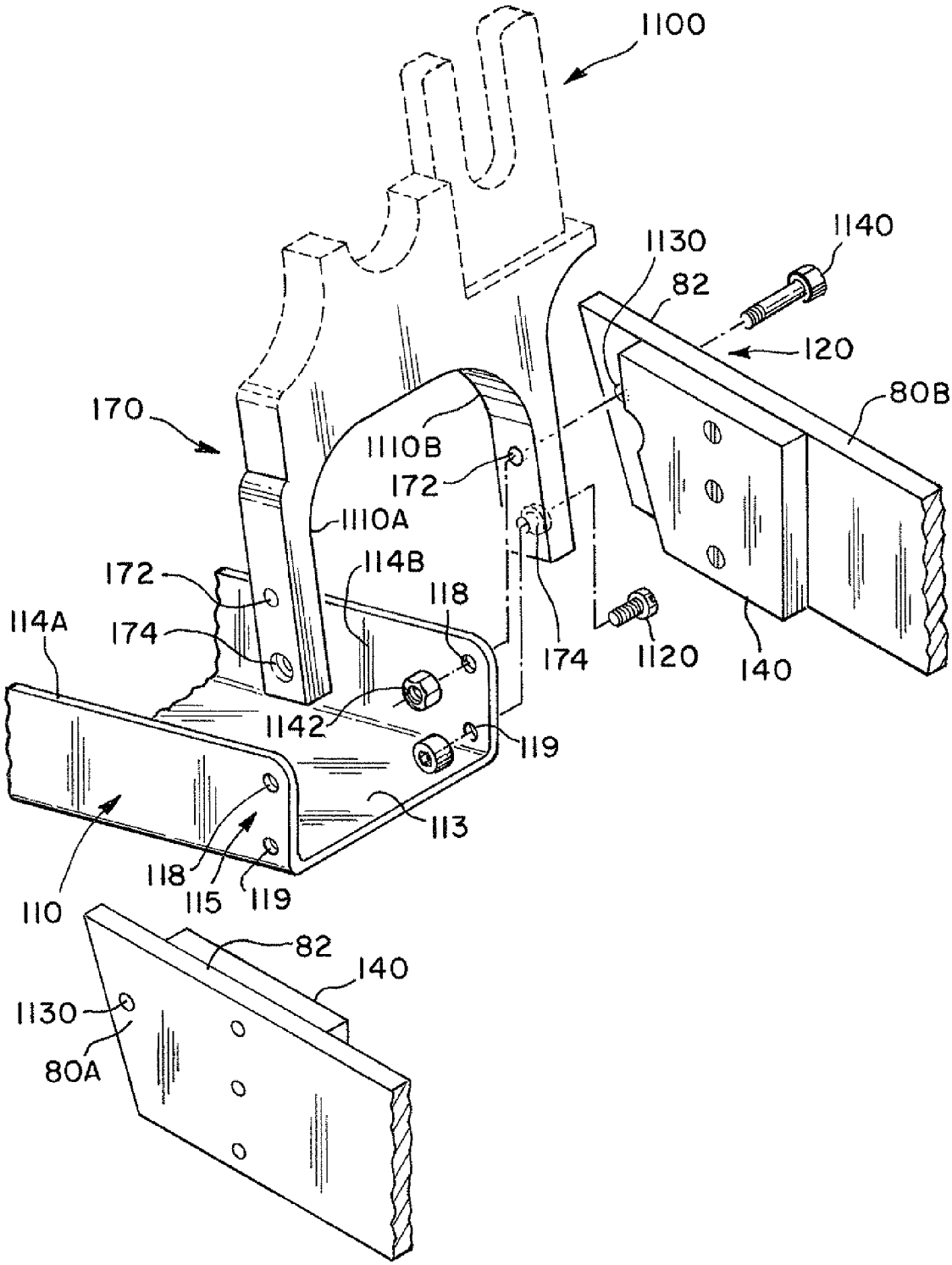
FIG. 11 is an exploded view showing the pivotal connection of the feed to the support arm.

FIG. 11 shows the attachment of the feed block 170 of feed 90 to the tray 110. The upper portion 1100 of the feed block 170 is shown dotted as it can be of any suitable configuration to connect to the feed 90. The present invention functions whether or not the feed 90 has a skew gear (not shown) for controlling skew of the feed during targeting. Hence, the term "feed block" includes feeds with or without skew control such as by a skew gear. The feed block 170 has two downwardly extending legs 1110A, 1110B that are configured to connect with the inside of tray 110. Tray 110 has a flat tray bottom 113 and opposing sides 114A, 114B. Formed holes 118, 119 are made at end 115. The feed block 170 has a first formed set of holes 172 and a second set of formed holes 174 in each leg 1110A, 1110B.

As shown in FIG. 11, the legs 1110A, 1110B are oriented to connect perpendicularly at the end 115 with the sides 114A, 114B between the legs 1110A, 1110B. A bolt 1120 engages hole 174 of leg 1110B and hole 119 of side 114B. A lock nut 1122 is used to firmly tighten the bolt 1120 in place to secure the feed block 170 to the tray 110. A similar bolt and nut is used to secure leg 1110A to side 114A.

The feed arm 80 has two parallel arms 80A and 80B. A hole 1130 is formed in end 82 of arms 80A, 80B. A pivot bolt 1140 enters hole 1130 and hole 172 and hole 118 to engage a lock nut 1142. Although not shown, a pivot bolt 1140 enters hole 1130 of arm 80A and hole 118 of side 114A to connect with a nut 1142. The connection allows the arms 80A, SOB to pivot with respect to the unitary tray 110/feed block 170 structure to create pivot 120. It is to be understood that this represents only one design and that other suitable designs could be varied and utilized herein. While the mobile satellite system 10 illustrated uses two parallel arms 80A, 80B in the feed arm 80, other systems 10 may use one arm or more than two arms.

Figure 12:
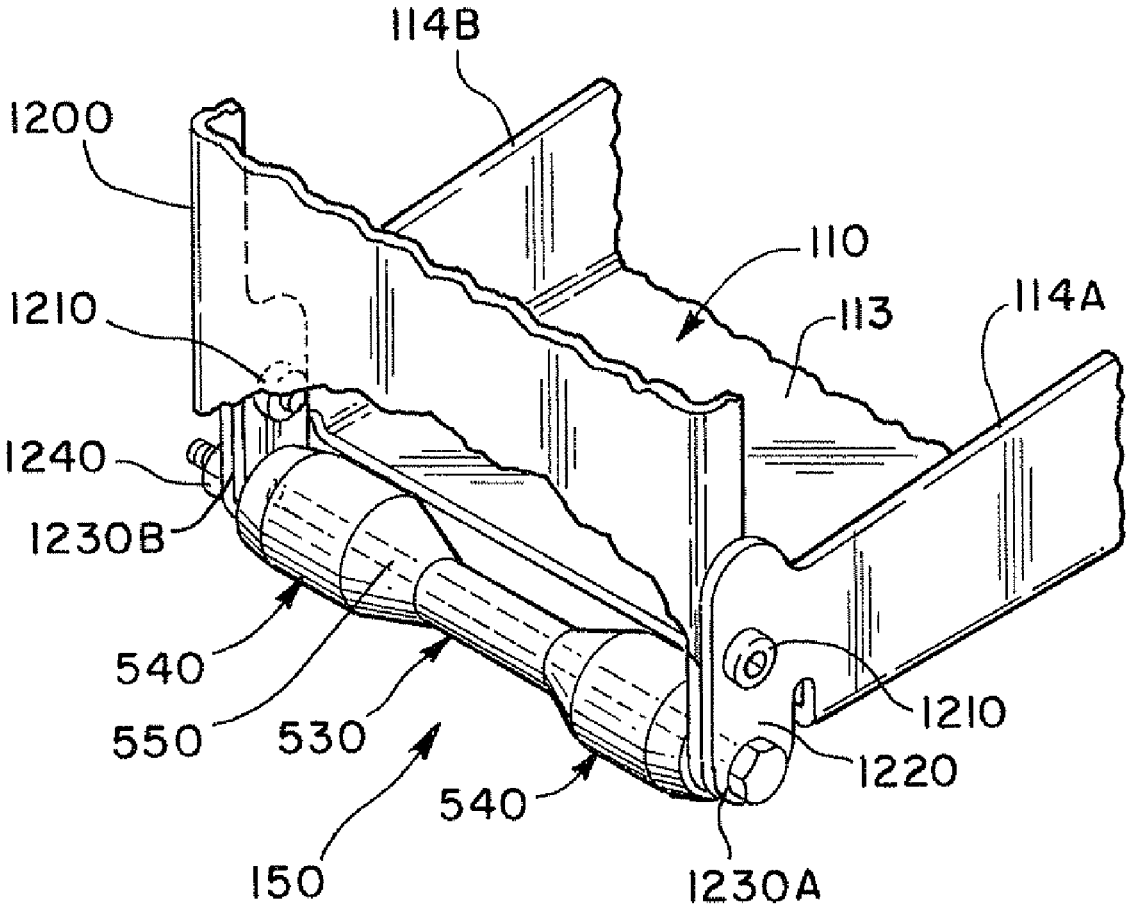
FIG. 12 is a perspective view of the roller of the present invention.

In FIG. 12, the tray 110 is shown connected 1210 to a feed support 1200. The details of the feed support 1200 vary based on design considerations, but the feed support 1200 provides support for the feed 90 as shown in FIG. 2. Here the tray 110 at end 1220 has downwardly extending regions 1230A, 1230B which extends below the bottom 112 and beyond the floor 113 of the tray 110 which has a formed hole (not shown) to receive an axle 550 which passes through a formed cylindrical hole (not shown) in the roller 150. When connected with nut 1240, roller 150 freely rolls on axle 550 between the regions 1230A, 1230B and below the bottom 113.

A folding feed mechanism and method 100 for a mobile satellite system 10 having a reflector antenna 20, a feed 90, and a feed arm 80, the feed arms has a distal end 82 from the reflector antenna to carry the feed at the distal end 82 when said reflector antenna 20 is deployed. A pivot 120 is formed between the distal end 82 of the feed arm 80. A feed stop block 140 is connected at the distal end 82 of the feed arm 80. The feed stop block 140 has first and second surfaces 44, 46. A gas spring 130 has a first end 134 operatively connected to the distal end 82 of the feed arm 80. The second end 132 of the gas spring 130 is operatively connected to the feed 90 at feed block 170. When the mobile satellite system 10 stows the reflector antenna 20, the feed 90 pivots about the pivot 120 to abut the first surface 144 of the feed stop block 140 against the feed 90 to hold the feed 90 at a first set angle 300 less than 180 degrees with the feed arm 90. When the mobile satellite system 10 deploys the reflector antenna 20, the feed 90 pivots about the pivot 120 to abut the second surface 146 of the feed stop block 140 against the feed 90 to hold the feed 90 at a second set angle 710 less than 180 degrees with the feed arm 80. The gas spring 130 applies a constant force to hold the second surface 146 against the feed 90. The first angle 300 is greater than the second angle 710 to provide a low profile to the stowed reflector antenna 20 in said mobile satellite system 10.

A method for folding the feed 90 of a mobile satellite system 10 by moving the feed 90 about a pivot 120 on the distal end 82 of the feed arm 80 as the mobile satellite system 10 stows as shown in FIG. 3; by stopping the movement of the feed 90 about the pivot 120 during stow when a first surface 142 of a feed stop block 140 on the distal end 82 abuts the feed 90 (as shown the feed block 170); by moving the feed 90 about the pivot 120 when the mobile satellite system deploys as shown in FIG. 7; by stopping the movement of the feed 90 about the pivot 120 during deploy when a second surface 144 of a feed stop block 140 on the distal end 82 abuts the feed 90 (as shown by feed block 170); and by holding the feed 90 against the second surface 144 with a spring 130 connected between the feed 90 and the feed arm 80.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A folding feed mechanism for a mobile satellite system, said mobile satellite system having a reflector antenna, a feed, and a feed arm; said feed arm having a distal end from said reflector antenna, said feed arm carrying said feed at said distal end when said reflector antenna is deployed; said folding feed mechanism comprising:

a pivot connection between said distal end of said feed arm and said feed;

at least one feed stop block connected at said distal end of said feed arm, said feed stop block having first and second surfaces;

a spring having two ends, said first end of said spring operatively connected to said feed arm, said second end of said spring operatively connected to said feed;

when said mobile satellite system stows said reflector antenna, said feed pivoting about said pivot connection to abut said first surface of said feed stop block against said feed to hold said feed at a first set angle less than 180 degrees with said feed arm;

when said mobile satellite system deploys said reflector antenna, said feed pivoting about said pivot connection to abut said second surface of said feed stop block against said feed to hold said feed at a second set angle less than 180 degrees with said feed arm, said spring applying a force to hold said second surface against feed;

said first set angle greater than said second set angle to provide a low profile to said stowed reflector antenna in said mobile satellite system.

2. The folding feed mechanism of claim 1 wherein said feed arm comprises a pair of arms wherein said at least one feed block is a pair of feed blocks and wherein each arm in said pair is connected to one of said pair of feed blocks.

3. The folding feed mechanism of claim 1 wherein said feed further comprises a feed block and wherein said first and second surfaces abut said feed block.

4. The folding feed mechanism of claim 1 wherein said spring is a gas spring.

5. The folding feed mechanism of claim 1 wherein said force is a constant force applied by said spring.

6. The folding feed mechanism of claim 1 wherein said second set angle provides a fixed focus angle for said feed when said reflector antenna is deployed by said mobile satellite system.

7. The folding feed mechanism of claim 1 wherein said at least one feed stop block comprises:

two opposing sides;

said first and second surfaces located between said two opposing sides, said first and second surfaces oriented toward said distal end of said feed arm.

8. The folding feed mechanism of claim 1 wherein said at least one feed stop block further comprises a transition region between said first and second surfaces.

9. The folding feed mechanism of claim 8 wherein said first surface forms an angle of about 98 degrees with one of said opposing sides;

wherein said second surface forms an angle of about 60 degrees, when said focus angle is 30 degrees, with the other one of said opposing sides; and wherein said transition region is a curved surface.

10. The folding feed mechanism of claim 1 wherein said force applied by said spring holds said feed firmly against said at least one feed stop block.

11. The folding feed mechanism of claim 10 wherein said force is 15 pounds.

12. A folding feed mechanism for a mobile satellite system, said mobile satellite system having a reflector antenna, a feed, and a feed arm; said feed arm having a distal end from said reflector antenna, said feed arm carrying said feed when said reflector antenna is deployed; said folding feed mechanism comprising:

a tray, said tray having first and second opposing ends;

a feed block connected at said first end of said tray, said feed mounted to said feed block;

said tray pivotally connected to said distal end of said feed arm at said first opposing end;

at least one feed stop block connected at said distal end of said feed arm, said at least one feed stop block having first and second surfaces;

a spring having two ends, said first end of said spring operatively connected to said feed arm, said second end of said spring operatively connected to said feed block, when said mobile satellite system stows said reflector antenna, said first angled surface of said feed stop block abuts against said feed block to hold said tray on said stow ramp;

when said mobile satellite system deploys said reflector antenna, said second angled surface of said feed stop block abuts against said feed block to hold said feed at a set angle to said feed arm, said spring applying a force to hold said second angled surface against feed block.

13. The folding feed mechanism of claim 12 further comprising:

a stow ramp;

a guide formed in the center of said stow ramp and extending a given length;

a roller rotationally connected at said second opposing end of said tray;

when said mobile satellite system moves said reflector antenna towards said stow ramp to stow said reflector antenna, said roller engages said formed guide to pivot said tray to move said second angled surface of said feed stop block away from said feed block and to move said first angled surface towards said feed block.

14. The folding feed mechanism of claim 12 wherein said feed arm comprises a pair of arms wherein said at least one feed block is a pair of feed blocks and wherein each arm in said pair is connected to one of said pair of feed blocks.

15. The folding feed mechanism of claim 12 wherein said second set angle provides a fixed focus angle for said feed when said reflector antenna is deployed by said mobile satellite system.

16. The folding feed mechanism of claim 12 wherein said at least one feed stop block comprises:

two opposing sides;

said first and second surfaces located between said two opposing sides, said first and second surfaces oriented toward said distal end of said feed arm.

17. The folding feed mechanism of claim 12 wherein said feed arm comprises a pair of arms wherein said at least one feed block is a pair of feed blocks and wherein each arm in said pair is connected to one of said pair of feed blocks.

18. A folding feed mechanism for a mobile satellite system, said mobile satellite system having a reflector antenna, a feed, a feed arm and a stow ramp; said feed arm having a distal end, from said reflector antenna, carrying said feed when said reflector antenna is deployed; said feed mechanism comprising:

a tray, said tray having first and second ends;

a feed block connected at said first end of said tray to extend perpendicular to said tray, said feed mounted to said feed block;

said tray pivotally connected to said distal end of said feed arm at said first opposing end;

at least one feed stop block connected at said distal end of said feed arm, said at least one feed stop block having first and second surfaces;

a gas spring having two ends, said first end of said spring operatively connected to said feed arm, said second end of said spring operatively connected to said feed block;

when said mobile satellite system stows said reflector antenna, said first angled surface of said feed stop block abuts against said feed block to hold said tray on said stow ramp;

when said mobile satellite system deploys said reflector antenna, said second angled surface of said feed stop block abuts against said feed block to hold said feed at a set angle to said feed arm, said spring applying a force to hold said second angled surface against feed block;

a guide formed in the center of said stow ramp and extending a given length;

a roller rotationally connected at said second opposing end of said tray;

when said mobile satellite system moves said reflector antenna towards said stow ramp to stow said reflector antenna, said roller engages said formed guide to pivot said tray to move said second angled surface of said feed stop block away from said feed block and to move said first angled surface towards said feed block.

19. The folding feed mechanism of claim 18 wherein said feed arm comprises a pair of arms wherein said at least one feed block is a pair of feed blocks and wherein each arm in said pair is connected to one of said pair of feed blocks.

20. A method for folding a feed of a mobile satellite system, the method comprising:

moving the feed about a pivot on a distal end of a feed arm when the mobile satellite system stows;

stopping the aforesaid movement of the feed about the pivot during stow when a first surface of a feed stop block on the distal end abuts the feed;

moving the feed about the pivot when the mobile satellite system deploys;

stopping the aforesaid movement of the feed about the pivot during deploy when a second surface of a feed stop block on the distal end abuts the feed;

holding the feed against the second surface with a spring connected between the feed and the feed arm.

* * * * *